US011568841B2

(12) United States Patent
Chen

(10) Patent No.: US 11,568,841 B2
(45) Date of Patent: Jan. 31, 2023

(54) PEDAL ASSEMBLY FOR PERCUSSION INSTRUMENT

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 108 days.

(21) Appl. No.: 17/322,039

(22) Filed: May 17, 2021

(65) Prior Publication Data

US 2022/0366878 A1 Nov. 17, 2022

(51) Int. Cl.
*G10D 13/11* (2020.01)
*G10D 13/02* (2020.01)

(52) U.S. Cl.
CPC ..... *G10D 13/11* (2020.02); *G10D 13/02* (2013.01)

(58) Field of Classification Search
CPC ..... G10D 13/11; G10D 13/02
See application file for complete search history.

(56) References Cited

U.S. PATENT DOCUMENTS 7,928,305 B1 * 4/2011 Chen ..... G10D 13/11 84/422.1
10,937,400 B1 * 3/2021 Chu ..... G10D 13/02
11,450,299 B1 * 9/2022 Ruprecht ..... G10D 13/11

* cited by examiner

*Primary Examiner* — Robert W Horn
(74) *Attorney, Agent, or Firm* — Muncy, Geissler, Olds & Lowe, P.C.

(57) ABSTRACT

A pedal assembly for a percussion instrument is provided, including: a base, a shaft, a pedal and a returning mechanism. The base includes a bottom plate and a first rod member disposed on the bottom plate. The shaft is rotatably disposed on the first rod member about an axial direction. The pedal is swingably connected between the bottom plate and the shaft. The returning mechanism includes an axial rod being co-movable with the shaft, a housing sleeved to the axial rod, an elastic member received in the housing and an adjusting assembly connected with the housing. The elastic member is located between the axial rod and the housing, and a relative position of the housing and the axial rod is adjustable by the adjusting assembly.

11 Claims, 7 Drawing Sheets

PEDAL ASSEMBLY FOR PERCUSSION INSTRUMENT

BACKGROUND OF THE INVENTION

Field of the Invention

The present invention relates to a pedal assembly for a percussion instrument.

Description of the Prior Art

A conventional pedal mechanism for a percussion instrument (such as drum or cymbals) includes a pedal portion, a hitting portion and a linkage portion connected between the pedal portion and the hitting portion. The linkage portion includes a returning assembly, and the returning assembly may include a spring driving the hitting portion to have a tendency to move in a direction away from the percussion instrument, which allows the hitting portion to return automatically to its original position after hitting. Specifically, a force that the returning assembly driving the hitting portion and the pedal directly effects moving speed of the pedal portion, operation comfortability and force that the hitting portion hitting the percussion instrument and thereby affects the tone and volume of the percussion instrument and hitting accuracy. Therefore, tension of the spring should be adjustable to meet various requirements.

However, an adjusting member for adjusting the tension of the spring is directly connected with the spring so that the adjusting member is easily dislocated due to an elastic force of the spring during adjustment, which is inconvenient to operate. In addition, components of the returning assembly are easy to move and collide with one another when the pedaling portion is actuated, which results in noises.

The present invention is, therefore, arisen to obviate or at least mitigate the above-mentioned disadvantages.

SUMMARY OF THE INVENTION

The main object of the present invention is to provide a pedal assembly for a percussion instrument, which has a returning mechanism being convenient to adjust.

To achieve the above and other objects, the present invention provides a pedal assembly for a percussion instrument, includes a base, a shaft, a pedal and a returning mechanism. The base includes a bottom plate and a first rod member disposed on the bottom plate. The shaft is rotatably disposed on the first rod member about an axial direction. The pedal is swingably connected between the bottom plate and the shaft. The returning mechanism includes an axial rod being co-movable with the shaft, a housing sleeved to the axial rod, an elastic member received in the housing and an adjusting assembly connected with the housing. The elastic member is located between the axial rod and the housing, and a relative position of the housing and the axial rod is adjustable by the adjusting assembly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
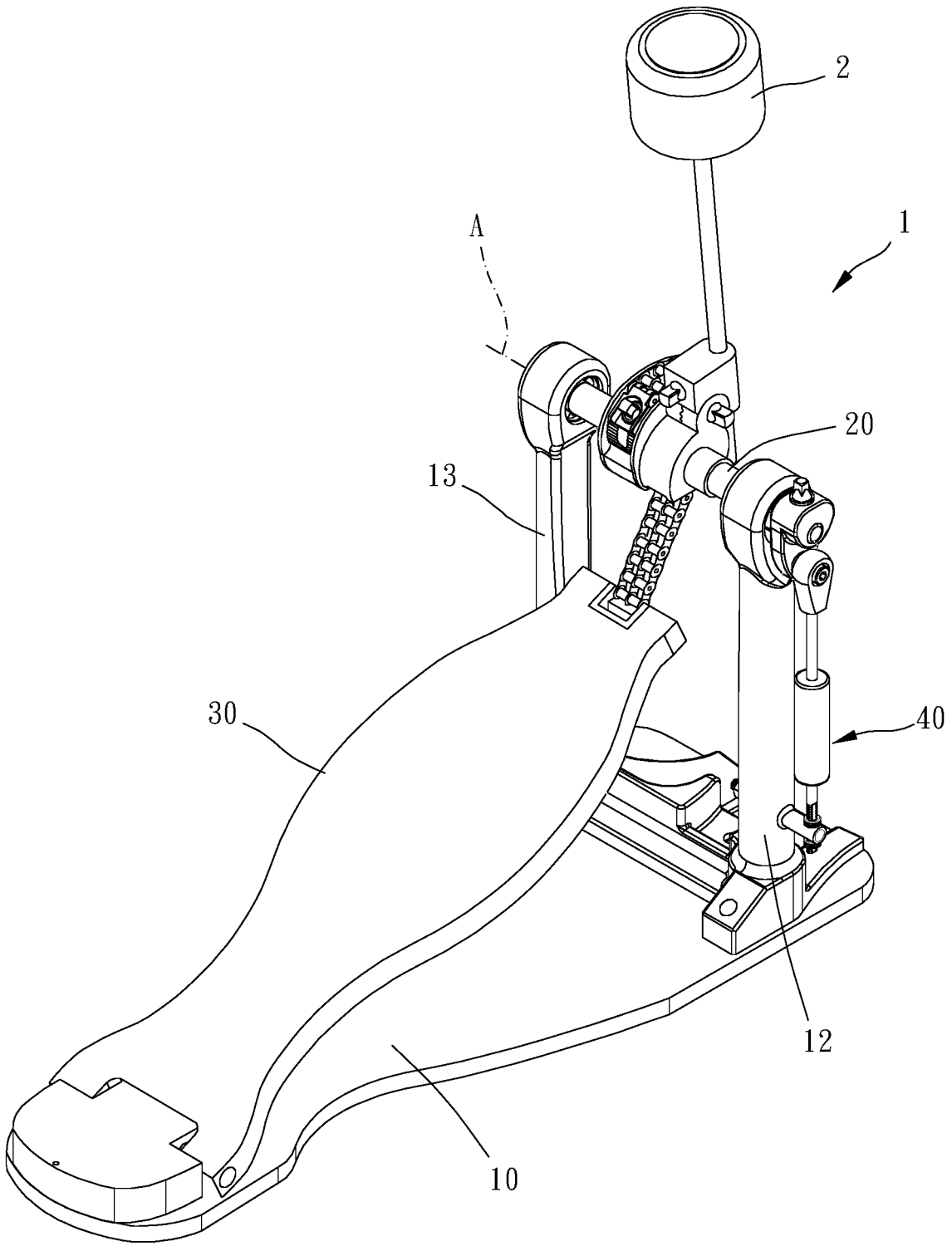
FIG. 1 is a stereogram of a preferable embodiment of the present invention.
Figure 2:
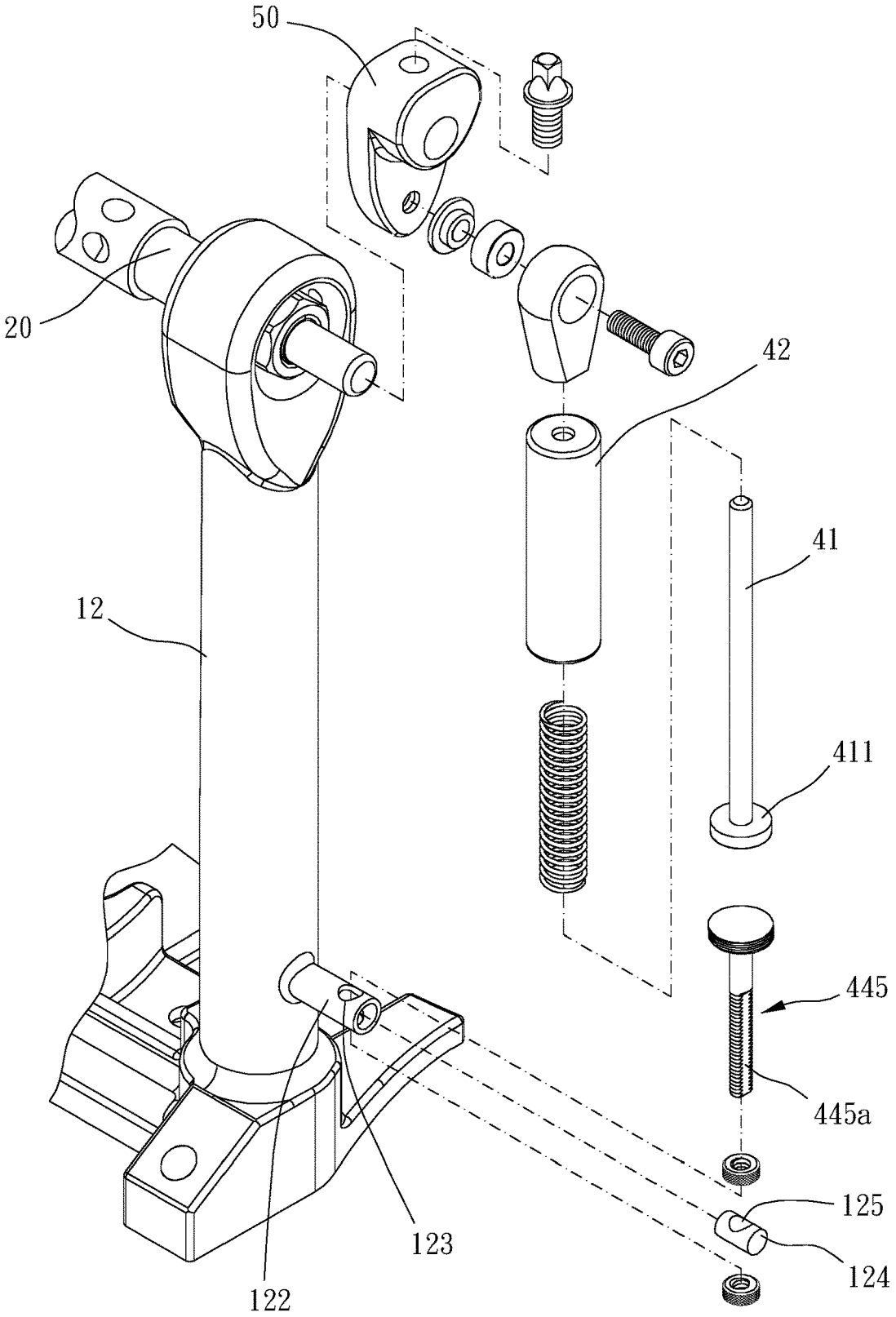
FIG. 2 is a breakdown drawing of a preferable embodiment of the present invention.
Figure 3:
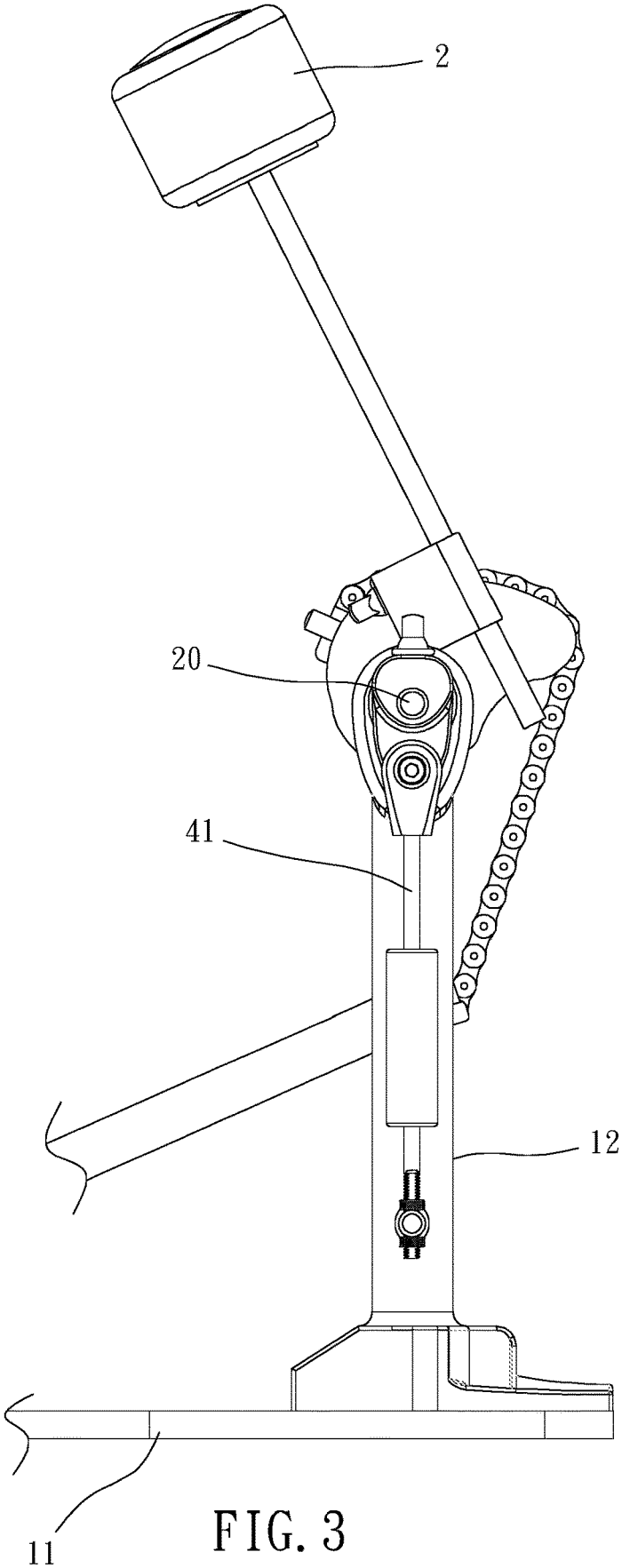
FIG. 3 is a partial side view of a preferable embodiment of the present invention.
Figure 4:
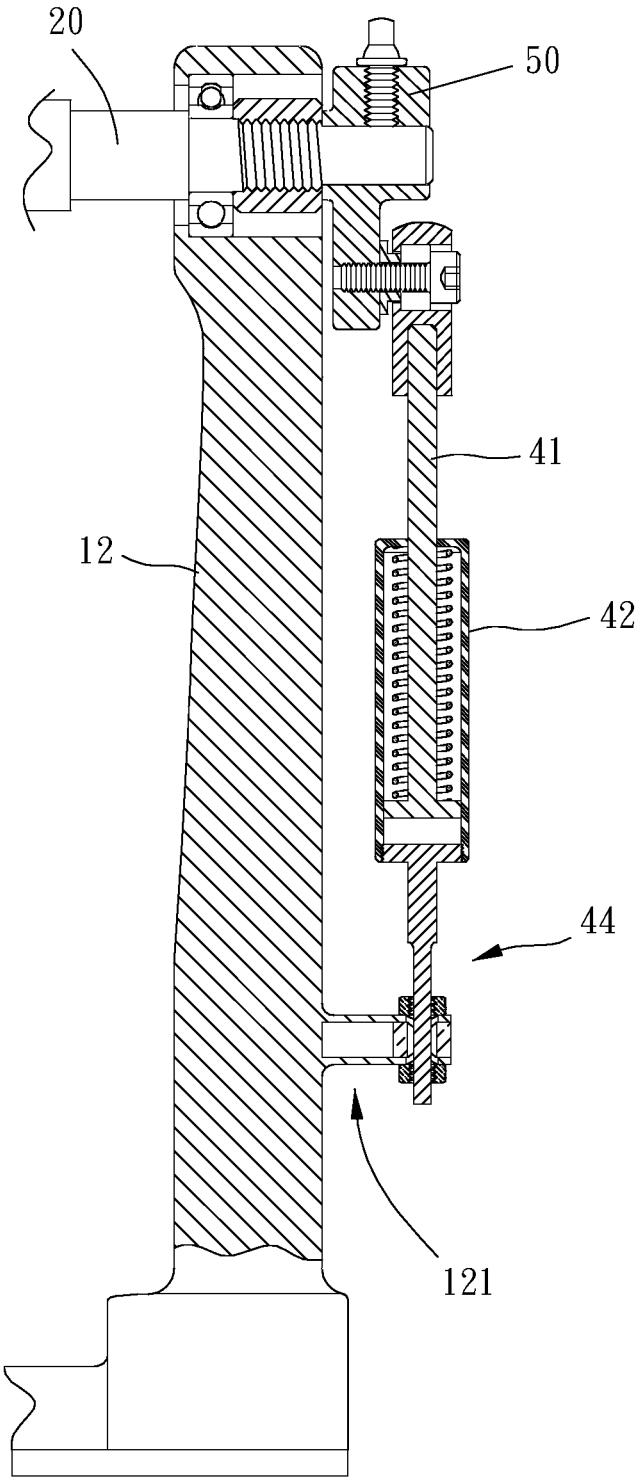
FIG. 4 is a partial cross-sectional view of a preferable embodiment of the present invention.
Figure 5:
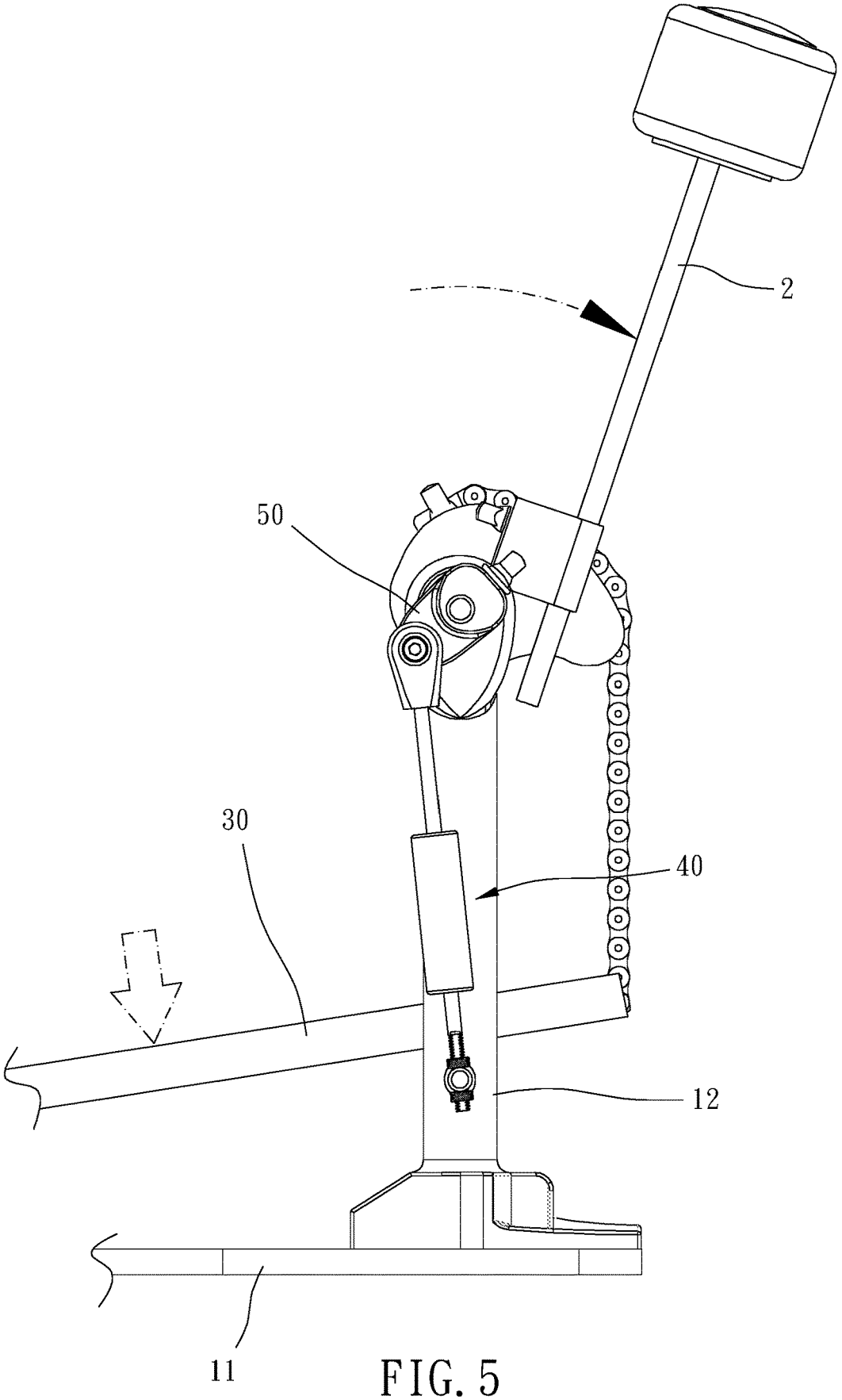
FIG. 5 is a drawing showing operation according to a preferable embodiment of the present invention.
Figure 6:
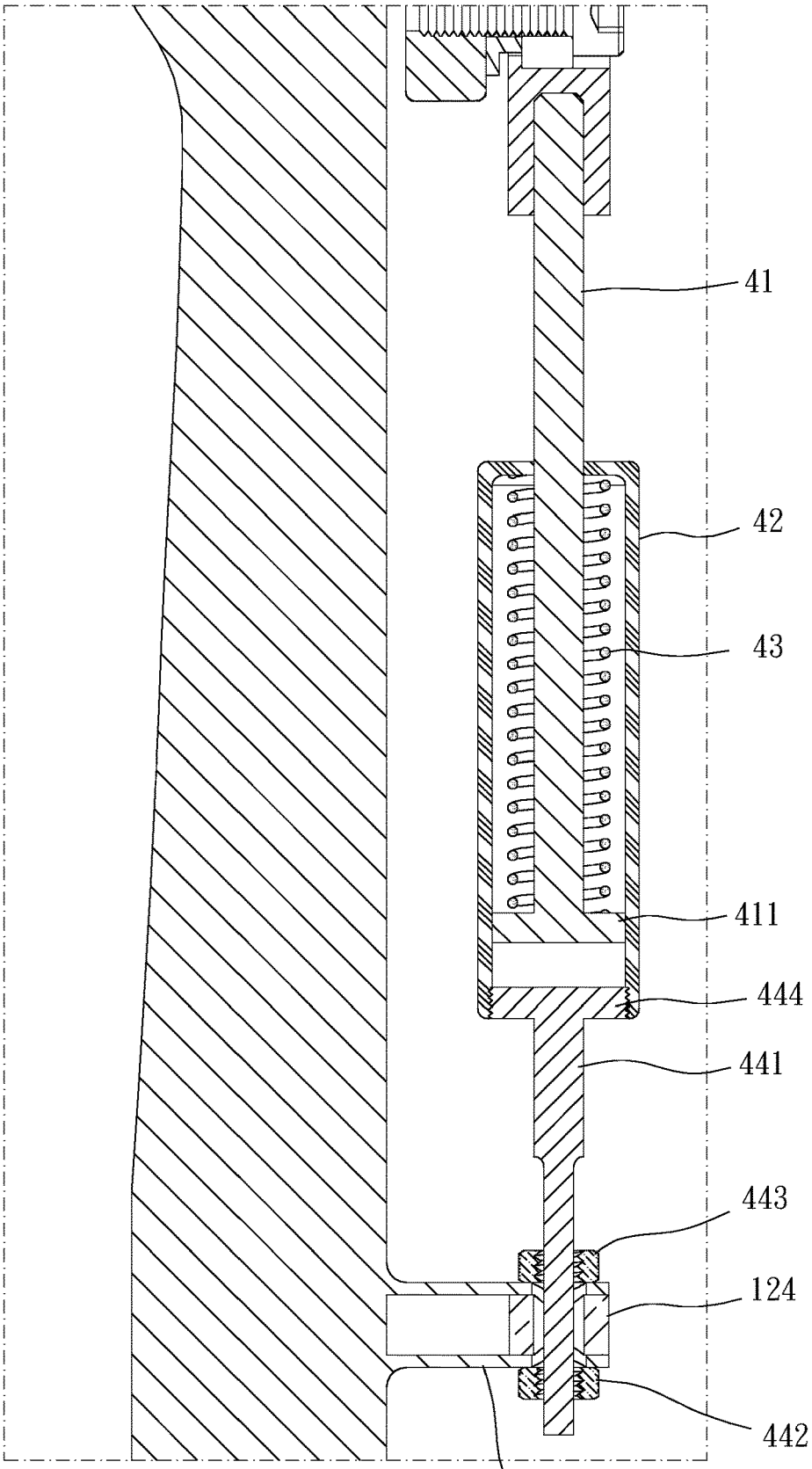
FIGS. 6 and 7 are drawings showing adjustment of a returning mechanism according to a preferable embodiment of the present invention.
Figure 7:
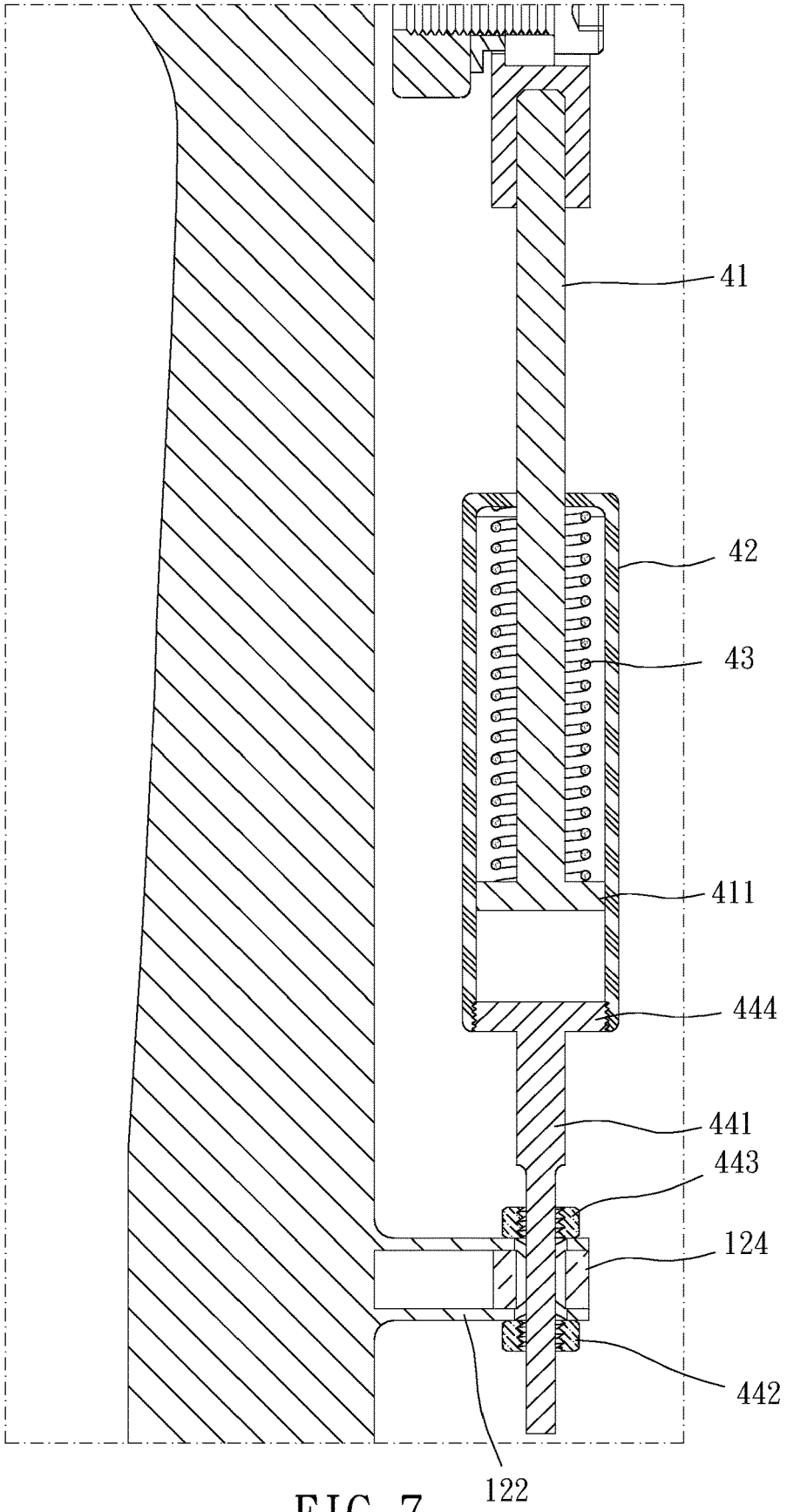

Please refer to FIGS. 1 to 7 for a preferable embodiment of the present invention. A pedal assembly 1 for a percussion instrument of the present invention includes a base 10, a shaft 20, a pedal 30 and a returning mechanism 40.

The base 10 includes a bottom plate 11 and a first rod member 12 disposed on the bottom plate 11. The shaft 20 is rotatably disposed on the first rod member 12 about an axial direction A. The pedal 30 is swingably connected between the bottom plate 11 and the shaft 20. The returning mechanism 40 includes an axial rod 41 being co-movable with the shaft 20, a housing 42 sleeved to the axial rod 41, an elastic member 43 received in the housing 42 and an adjusting assembly 44 connected with the housing 42. The elastic member 43 is located between the axial rod 41 and the housing 42, and a relative position of the housing 42 and the axial rod 41 is adjustable by the adjusting assembly 44, which is easy to operate and allows a tension of the elastic member 43 to be adjusted for various requirements.

A side of the first rod member 12 remote from the shaft 20 has a connecting portion 121 radially disposed thereon, and the adjusting assembly 44 is connected between the housing 42 and the connecting portion 121 so as to disperse force exerted on the axial rod 41. The adjusting assembly 44 includes a connecting member 441 disposed through the connecting portion 121 and a first adjusting member 442 adjustably positioned on the connecting member 441, and the first adjusting member 442 is axially abuttable against a side of the connecting portion 121 remote from the housing 42. In this embodiment, the connecting member 441 includes a head portion 444 detachably covering an opening of the housing 42 for easy processing and assembling; the connecting member 441 includes an outer threaded section 445, and the first adjusting member 442 is screwed on the outer threaded section 445 so that the connecting member 441 is axially movable by rotating the first adjusting member 442 to drive the housing 42 to move away or toward the shaft 20 for changing the tension of the elastic member 43 (when the pedal 30 is not actuated). Preferably, the connecting member 441 is integrally formed in one piece so as to have good structural strength. The adjusting assembly 44 further includes a second adjusting member 443 adjustably positioned on the connecting member 441, and the second adjusting member 443 is located at a side of the connecting portion 121 opposite to the first adjusting member 442, which prevents the first adjusting member 442 from unexpected movement due to vibration. Therefore, when the pedal 30 is actuated, a drumstick 2 connected to the shaft 20 is directly driven to hit on a drumhead. When the pedal 30 is released, the housing 42 and the connecting member 441 are unmovable relative to the connecting portion 121 so that the elastic member 43 can directly drive the pedal 30 and the drumstick 2 to return to respective original position so as to reduce noise, avoid actuation delay and reset instantly. The outer threaded section 445 preferably has at least one cut surface 445*a* extending in an axial direction of the connecting member 441 so as to reduce friction between the outer threaded section 445 and the first adjusting member 442 and the second adjusting member 443 for quick adjustment. In operation, the first adjusting member 442 and the second adjusting member 443 are screwed to be free of abutment with the connecting portion 121, and an operator can move the housing 42 to an expected position by one hand and screw the first adjusting member 442 and the second adjusting member 443 to restrict with the connecting portion 121 by the other hand, which is easy to operate. In other embodiments, the connecting portion may be disposed on the first rod member or other positions; the adjusting assembly may be disposed on an end of the axial rod adjacent to the shaft; the connecting member may include a plurality of recesses axially spaced apart from one another, and the first adjusting member may be a retainer releasably engaged within one of the plurality of recesses so that the tension of the elastic member is adjusted by changing a position of the retainer.

The connecting portion 121 includes a column 122 extending in a direction parallel to the axial direction A and being non-rotatable relative to the first rod member 12. The column 122 has an elongate slot 123 disposed thereon, and the adjusting assembly 44 is partially disposed through the elongate slot 123 for swinging relative to the connecting portion 121. The connecting portion 121 further includes a rotating member 124 rotatably received within the column 122, and the rotating member 124 has a through hole 125 corresponding to the elongate slot 123. The adjusting assembly 44 is partially disposed through the through hole 125. In other words, the connecting member 441 is disposed through the elongate slot 123 and the through hole 125, and the rotating member 124 allows the connecting member 441 to smoothly rotate relative to the column 122. In this embodiment, the column 122 integrally extends from the first rod member 12 so as to have good structural strength and be easy to manufacture; a diametrical dimension of the through hole 125 is smaller than a diametrical dimension of the elongate slot 123 so as to reduce noise caused by collision between the connecting member 441 and the column 122. When the shaft 20 is rotated to drive the returning mechanism 40 to swing relative to the first rod member 12, the first adjusting member 442 is biased against an outer circumferential surface of the column 122, which provides good positioning effect and stable operation.

The pedal assembly 1 for the percussion instrument further includes an assembling member 50 being co-rotatable with the shaft 20, and the axial rod 41 is rotatably connected with the assembling member 50 and deviated from the axial direction A so as to drive the shaft 20 to rotate. The base 10 further includes a second rod member 13 opposite to the first rod member 12, and the shaft 20 is rotatably connected between the first rod member 12 and the second rod member 13 for good structural strength and stable operation. An end of the axial rod 41 remote from the shaft 20 has a protruding portion 411 radially protruding therefrom, and the elastic member 43 is elastically abutted against and between the protruding portion 411 and the housing 42. Therefore, the shaft 20 has a tendency to rotate in a predetermined direction (which makes the drumstick 2 move away from the drumhead in this embodiment). Preferably, the protruding portion 411 is circumferentially abutted against an inner circumferential surface of the housing 42 to reduce noises caused by collision with the housing 42. The protruding portion 411 is a flange integrally extending from the axial rod 41 so as to have good structural strength. In other embodiments, the protruding portion may be made of plastic, rubber, or the like; the protruding portion may be a circular member restricted to the axial rod by a retainer.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pedal assembly for a percussion instrument, including:

a base, including a bottom plate and a first rod member disposed on the bottom plate;

a shaft, rotatably disposed on the first rod member about an axial direction;

a pedal, swingably connected between the bottom plate and the shaft; and a returning mechanism, including an axial rod being co-movable with the shaft, a housing sleeved to the axial rod, an elastic member received in the housing and an adjusting assembly connected with the housing, the elastic member being located between the axial rod and the housing, a relative position of the housing and the axial rod being adjustable by the adjusting assembly.

2. The pedal assembly for the percussion instrument of claim 1, wherein the first rod member has a connecting portion radially disposed thereon, and the adjusting assembly is connected between the housing and the connecting portion.

3. The pedal assembly for the percussion instrument of claim 2, wherein the adjusting assembly includes a connecting member disposed through the connecting portion and a first adjusting member adjustably positioned on the connecting member, and the first adjusting member is axially abuttable against a side of the connecting portion remote from the housing.

4. The pedal assembly for the percussion instrument of claim 3, wherein the adjusting assembly further includes a second adjusting member adjustably positioned on the connecting member, and the second adjusting member is located at a side of the connecting portion opposite to the first adjusting member.

5. The pedal assembly for the percussion instrument of claim 3, wherein the connecting member includes a head portion detachably covering an opening of the housing.

6. The pedal assembly for the percussion instrument of claim 3, wherein the connecting member includes an outer threaded section, the outer threaded section has at least one cut surface extending in an axial direction of the connecting member, and the first adjusting member is screwed on the outer threaded section.

7. The pedal assembly for the percussion instrument of claim 1, wherein an end of the axial rod remote from the shaft has a protruding portion radially protruding therefrom, and the elastic member is elastically abutted against and between the protruding portion and the housing.

8. The pedal assembly for the percussion instrument of claim 1, further including an assembling member being co-rotatable with the shaft, wherein the axial rod is rotatably connected with the assembling member and deviated from the axial direction.

9. The pedal assembly for the percussion instrument of claim 2, wherein the connecting portion includes a column extending in a direction parallel to the axial direction and being non-rotatable relative to the first rod member, the column has an elongate slot disposed thereon, and the adjusting assembly is partially disposed through the elongate slot.

10. The pedal assembly for the percussion instrument of claim 9, wherein the connecting portion further includes a rotating member rotatably received within the column, the rotating member has a through hole corresponding to the elongate slot, and the adjusting assembly is partially disposed through the through hole.

11. The pedal assembly for the percussion instrument of claim 4, wherein the connecting member includes a head portion detachably covering an opening of the housing; the connecting member further includes an outer threaded section, the outer threaded section has at least one cut surface extending in an axial direction of the connecting member, and the first adjusting member is screwed on the outer threaded section; the connecting member is integrally formed in one piece; an end of the axial rod remote from the shaft has a protruding portion radially protruding therefrom, and the elastic member is elastically abutted against and between the protruding portion and the housing; the protruding portion is circumferentially abutted against an inner circumferential surface of the housing; the pedal assembly for the percussion instrument further includes an assembling member being co-rotatable with the shaft, the axial rod is rotatably connected with the assembling member and deviated from the axial direction; the connecting portion includes a column extending in a direction parallel to the axial direction and being non-rotatable relative to the first rod member, the column has an elongate slot disposed thereon, and the adjusting assembly is partially disposed through the elongate slot; the column integrally extends from the first rod member; the connecting portion further includes a rotating member rotatably received within the column, the rotating member has a through hole corresponding to the elongate slot, and the adjusting assembly is partially disposed through the through hole; a diametrical dimension of the through hole is smaller than a diametrical dimension of the elongate slot; the base further includes a second rod member opposite to the first rod member, the shaft is rotatably connected between the first rod member and the second rod member; and when the shaft is rotated to drive the returning mechanism to swing relative to the first rod member, the first adjusting member is biased against an outer circumferential surface of the column.

* * * * *